US007866061B2

(12) United States Patent
Tatsumi et al.

(10) Patent No.: US 7,866,061 B2
(45) Date of Patent: Jan. 11, 2011

(54) CLOTHES DRYER

(75) Inventors: Hisao Tatsumi, Tokyo (JP); Koji Kashima, Tokyo (JP)

(73) Assignees: Kabushiki Kaisha Toshiba, Tokyo (JP); Toshiba Ha Products Co., Ltd., Osaka (JP); Toshiba Consumer Marketing Corporation, Tokyo (JP)

( * ) Notice: Subject to any disclaimer, the term of this patent is extended or adjusted under 35 U.S.C. 154(b) by 229 days.

(21) Appl. No.: 12/094,056

(22) PCT Filed: Nov. 13, 2006

(86) PCT No.: PCT/JP2006/322570

§ 371 (c)(1),
(2), (4) Date: May 16, 2008

(87) PCT Pub. No.: WO2007/058145

PCT Pub. Date: May 24, 2007

(65) Prior Publication Data

US 2009/0094852 A1 Apr. 16, 2009

(30) Foreign Application Priority Data

Nov. 17, 2005 (JP) ..... 2005-333011

(51) Int. Cl.
*D06F 58/04* (2006.01)
*D06F 58/24* (2006.01)
*F26B 11/02* (2006.01)
*F26B 21/06* (2006.01)

(52) U.S. Cl. ..... 34/595; 34/606; 34/607; 34/134; 34/77; 34/78

(58) Field of Classification Search ..... 34/72, 34/73, 76, 77, 78, 132, 604, 606, 607, 134, 34/138, 140, 595
See application file for complete search history.

(56) References Cited

U.S. PATENT DOCUMENTS

| | | | | |
|---|---|---|---|---|
| 2,280,512 | A * | 4/1942 | Hemming et al. | 62/280 |
| 2,755,072 | A * | 7/1956 | Kreuttner | 165/59 |
| 2,825,146 | A * | 3/1958 | Kostelich | 34/547 |
| 5,768,730 | A | 6/1998 | Matsumoto et al. | |
| 2005/0204755 | A1 * | 9/2005 | Nishiwaki et al. | 62/93 |

FOREIGN PATENT DOCUMENTS

CN 1133368 10/1996

(Continued)

OTHER PUBLICATIONS

Search Report from PCT/JP2006/322570.
English abstract for JP-9-56992A.
English abstract for JP-2003-265881A.
English abstract for JP-2001-183018A.
English translation of Claim 1 for JP-3103144.
Partial English language translation of JP-77116/1991.
Partial English language translation of JP-120552/1992.
Machine translation for JP-A-2003-265881.

(Continued)

*Primary Examiner*—Jiping Lu
(74) *Attorney, Agent, or Firm*—DLA Piper LLP US

(57) ABSTRACT

A clothes dryer includes a water tub, a rotating container located in the tub, a drive unit rotating the container, an air circulation blower circulating air in the tub, and a heat pump formed by circularly connecting an evaporator, a condenser, a compressor, a discharge airflow path leading to the outside of the clothes dryer, an airflow path switching unit switched so as to open the portion between the container and the evaporator in an airflow path in the drying operation, and to open the discharge airflow path in cooling a place where the clothes dryer is placed, an air inlet located in an upper wall between the evaporator and the condenser in the airflow path, an air discharge blower introducing air outside the airflow path from the air inlet to be passed through the evaporator, and a cooling device that cools down the condenser.

10 Claims, 9 Drawing Sheets

FOREIGN PATENT DOCUMENTS

| | | | | |
|---|---|---|---|---|
| EP | 467188 | A1 | * | 1/1992 |
| EP | 1146161 | A1 | * | 10/2001 |
| JP | 77116/1991 | | | 8/1991 |
| JP | 120552/1992 | | | 10/1992 |
| JP | 9-56992 | A | | 3/1997 |
| JP | 2001-183018 | A | | 7/2001 |
| JP | 2003-265881 | A | | 9/2003 |
| JP | 2004028356 | A | * | 1/2004 |
| JP | 3103144 | U | | 5/2004 |
| KR | 0128633 | | | 12/1998 |

OTHER PUBLICATIONS

Machine translation for JP-A-2001-183018.

Office Action issued in Taiwanese Appl 095121275 on Mar. 31, 2009.

English Language Translation of Office Action issued in Taiwanese Appl 095121275 on Mar. 31, 2009.

English Machine Translation for JP 09-056992.

Office Action issued in CN Appl 200680042904.4 on Feb. 1, 2010.

English Language Translation of Office Action issued in CN Appl 200680042904.4 on Feb. 1, 2010.

Office Action issued in KR Appl 2008-7011197 on Apr. 29, 2010.

English Language Translation of Office Action issued in KR Appl 2008-7011197 on Apr. 29, 2010.

English Abstract of KR Publication 0128633 published Dec. 15, 1998.

* cited by examiner

CLOTHES DRYER

TECHNICAL FIELD

The present invention relates to a clothes dryer having a heat pump for drying clothes.

BACKGROUND ART

A clothes dryer having a heat pump for drying clothes has attracted attention as a dryer which is excellent in its drying performance and has the effect of energy savings. In the clothes dryer, an evaporator and a condenser forming the heat pump are circularly connected to a compressor so as to be disposed in an airflow path. The clothes dryer circulates air in a rotating container that houses laundry therein and rotates via the airflow path, and cools down the air circulated in the airflow path to be dehumidified by the evaporator, and heats the air by the condenser to be fed into the rotating container. In this way, the clothes dryer gradually dries clothes by repeatedly passing the air drawing moisture from the clothes through the airflow path.

In the clothes dryer, the evaporator condenses and collects water vapor generated from the clothes at the time of drying clothes. The compressor compresses refrigerant from which latent heat is collected at the time of condensing water vapor, so as to be converted into refrigerant at a high temperature. The condenser heats up air used for drying with the high-temperature refrigerant. In this way, provided that the latent heat obtained at the time of condensing water vapor is utilized as energy for heating up air used for drying, even if there is slight heat release (energy loss) to the outside, it is possible to reuse most of the energy without letting it escape. Accordingly, it is possible to realize highly-efficient drying.

In a clothes dryer disclosed in Japanese Published Unexamined Patent Application No. 9-56992 (Prior Art Document 1), an airflow path is blocked off at a portion between an evaporator and a condenser. Then, air outside the airflow path is passed through the evaporator (cooler) to be discharged to the outside of the clothes dryer, which performs cooling of a space such as a washroom where the clothes dryer is placed.

DISCLOSURE OF THE INVENTION

Problems to be Solved by the Invention

In accordance with the clothes dryer formed as in the prior art document 1, it is considered possible to perform cooling of the space where the clothes dryer is placed. However, the clothes dryer is not configured to cool down the condenser generating heat in the cooling operation. Therefore, the condenser continues to exist in the calm airflow path without radiating heat energy absorbed when the evaporator cools down air and heat energy added due to the working of the compressor. Accordingly, it has been practically impossible to cool down the air outside the airflow path by the evaporator, and it has been practically impossible to perform cooling of the space where the clothes dryer is placed.

An object of the present invention is to provide a clothes dryer capable of performing cooling of a space where the clothes dryer is placed by utilizing a heat pump for drying clothes.

Means for Solving the Problems

The present invention provides a clothes dryer to perform a drying operation for drying clothes, comprising a water tub having a hot-air exit formed in a front thereof and a hot-air entrance formed in a rear thereof, a rotating container provided in the water tub, an airflow path connecting the hot-air exit and the hot-air entrance to each other, a drive unit that rotates the rotating container, an air circulation blower that circulates air in the water tub from the hot-air exit through the airflow path and the hot-air entrance into the water tub, and a heat pump formed by circularly connecting an evaporator and a condenser both of which are disposed in the airflow path, and a compressor, a discharge airflow path leading to the outside of the clothes dryer from a portion between the rotating container and the evaporator in the airflow path toward a front of the clothes dryer, an airflow path switching unit which is switched so as to open the portion between the rotating container and the evaporator in the airflow path in the drying operation, and to open the discharge airflow path in cooling an atmosphere in a place where the clothes dryer is placed, an air inlet provided in a portion of an upper wall between the evaporator and the condenser in the airflow path, said upper wall defining the airflow path, an air discharge blower that introduces air outside the airflow path from the air inlet to be passed through the evaporator, and discharges the air from the discharge airflow path to the outside of the clothes dryer, and a cooling device that cools down the condenser.

EFFECT OF THE INVENTION

In accordance with the clothes dryer of the present invention, when the airflow path switching unit is switched so as to open the discharge airflow path, and the heat pump, the air blower for discharge, and the cooling device are operated in this state, it is possible not only to cool down the condenser by the cooling device, but also to cool down air outside the airflow path introduced from the air inlet by the evaporator, and to discharge the air from the discharge airflow path to the outside of the clothes dryer. In accordance therewith, it is possible to perform cooling of the space where the clothes dryer is placed by utilizing the heat pump for drying clothes.

BEST MODE FOR CARRYING OUT THE INVENTION

First Embodiment

Hereinafter, a first embodiment of the present invention will be described with reference to FIGS. 1 to 5.

Figure 1:
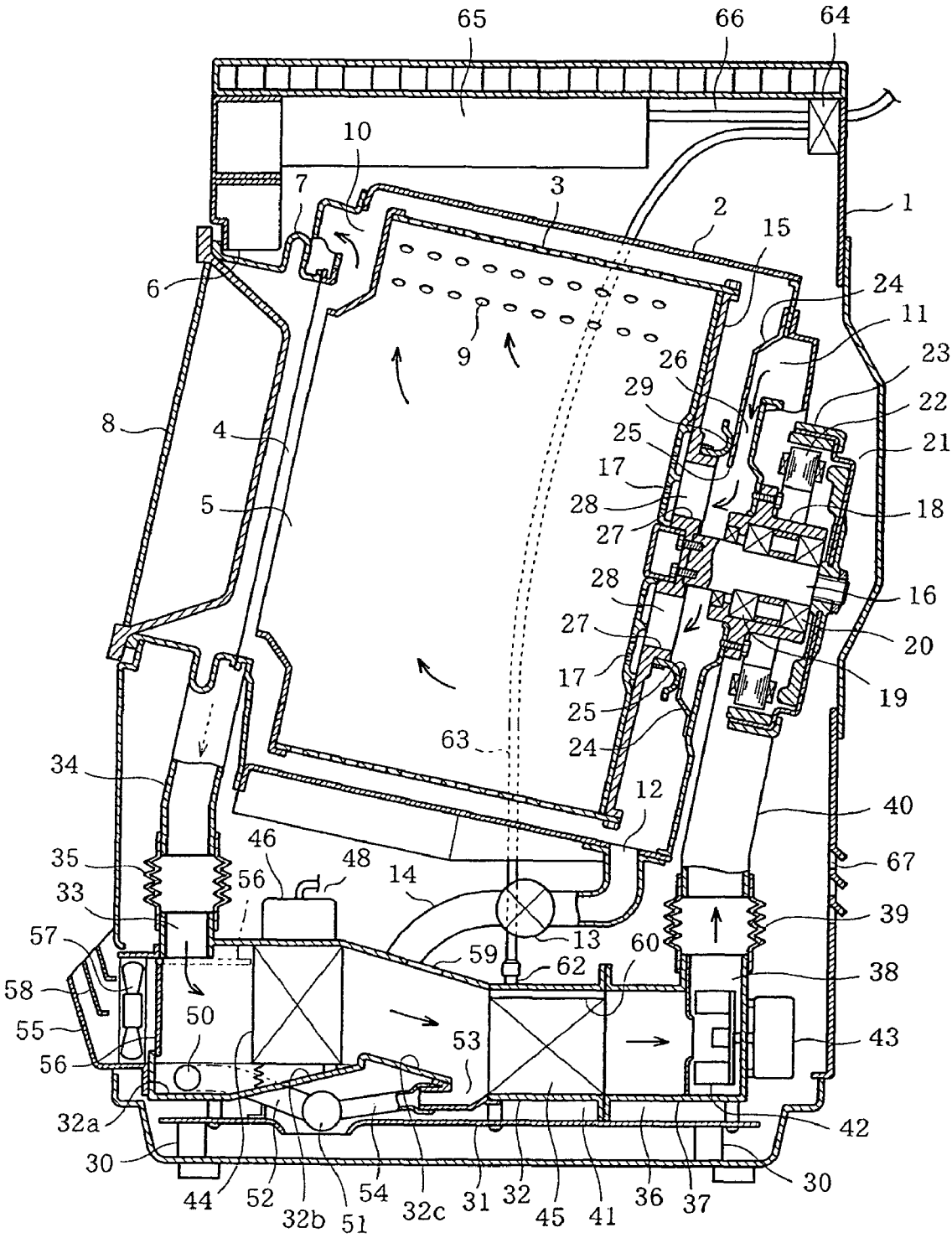
FIG. 1 is a longitudinal sectional side view showing a state in the drying operation of a clothes dryer in a first embodiment of the present invention.

FIG. 1 illustrates an entire structure of a transverse drum type washer-dryer. A water-tub 2 is disposed inside an outer casing 1 forming an outer shell of the washer-dryer, and a rotating container 3 (a drum) is disposed inside the water-tub 2.

Water tub 2 and the rotating container 3 are each formed in a cylindrical shape. An opening 4 is provided in the front face (the left side face in FIG. 1) of the water-tub 2. Further, an opening 5 is provided in the front face of the rotating container 3. The opening 5 of the rotating container 3 is for taking out and putting in laundry (clothes), and is surrounded by the opening 4 of the water tub 2. An opening 6 for taking out and putting in laundry is provided in the front face of the outer casing 1, and the opening 6 is connected to the opening 4 of the water tub 2 with a bellows 7. Further, a door 8 is provided so as to be openable and closable to the opening 6 of the outer casing 1.

Holes 9 (only some of those are illustrated) are formed in substantially the entire area of a circumferential lateral (body portion) of the rotating container 3. The holes 9 function as water flow holes in the washing operation and in the dehydrating operation, and function as airflow holes in the drying operation. A hot-air exit 10 is formed in the upper portion (the portion above the opening 4) of the front face of the water tub 2, and a hot-air entrance 11 is formed in the upper portion of the back face of the water tub 2. A drain outlet 12 is formed in the bottom portion at the back face side of the water-tub 2, and the drain outlet 12 is connected to a drain valve 13 outside the water tub 2. A drain hose 14 is connected to the drain valve 13, and water in the water tub 2 is discharged to the outside of the washer-dryer.

A reinforcement member 15 is attached to the back face of the rotating container 3. A rotating shaft 16 is attached via the reinforcement member 15 to the central portion of the back face of the rotating container 3. The rotating shaft 16 is attached so as to be protruded backward from the reinforcement member 15. A hot-air inlet 17 formed from many small holes is formed around the central portion of the back face of the rotating container 3.

In contrast thereto, a bearing housing 18 is attached to the central portion of the back face of the water tub 2. The rotating shaft 16 is inserted into the central portion of the bearing housing 18, and is supported rotatably by a bearing 19 and a bearing 20. In accordance therewith, the rotating container 3 is supported rotatably so as to be coaxial with the water tub 2. The water tub 2 is elastically supported in the outer casing 1 by an unillustrated suspension, and is transversely disposed in a state in which its axial direction is inclined such that its front side is raised (the left side is raised in FIG. 1) in the front-back direction (in the horizontal direction in FIG. 1). Accordingly, the rotating container 3 supported by the water tub 2 as described above is transversely disposed in a state in which its axial direction is inclined such that its front side is raised in the front-back direction.

A stator 22 forming a motor 21 is attached to the outer circumferential portion of the bearing housing 18. On the other hand, a rotor 23 forming the motor 21 is attached to the rear end portion of the rotating shaft 16. In this case, the rotor 23 is set so as to face the stator 22 from the outside. That is, the motor 21 is an outer rotor type brushless DC motor, and functions as a drive unit to rotate the rotating container 3 centering on the rotating shaft 16.

A hot-air cover 24 having an opening 25 in substantially the center thereof is provided to the inner side of the back face of the water-tub 2. The opening 25 of the hot-air cover 24 is provided so as to surround the circumference of the rotating shaft 16. A portion above the opening 25 of the hot-air cover 24 is configured to cover the hot-air entrance 11 so as to face the hot-air entrance 11. Further, the hot-air cover 24 is provided such that substantially the entire portion thereof has a predetermined distance from the back face of the water tub 2 (for example, a distance of approximately ⅓ of a space between the back face of the rotating container 3 and the back face of the water tub 2). In accordance therewith, a space partitioned by the hot-air cover 24 is formed between the back face of the rotating container 3 and the back face of the water tub 2. Then, the space between the back face of the water tub 2 and the hot-air cover 24 functions as a hot-air path 26 leading from the hot-air entrance 11 to the opening 25 (the space around the rotating shaft 16). In addition the opening 25 of the hot-air cover has a diameter which is set so as to be sufficiently larger than the diameter of the rotating shaft 16, and functions as an exit portion of the hot-air path 26.

A plurality of large holes 27 is provided in the circumferential portion of the rotating shaft 16 of the reinforcement member 15. The holes 27 are adapted to communicate between the opening 25 of the hot-air cover 24 and the hot-air inlet 17 of the rotating container 3, whereby a hot-air introduction path 28 is formed.

Further, a sealing member 29 is mounted onto the outer circumferential portion of the portion at which the hot-air induction path 28 is formed in the reinforcement member 15. The sealing member 29 is formed of an elastic material such as synthetic rubber, and touches the circumferential portion of the opening 25 of the hot-air cover 24 and slidably contacts the circumferential portion of the opening 25 of the hot-air cover 24 in accordance with the rotation of the rotating container 3. As a result, the sealing member 29 is to seal between the hot-air induction path 28 and the hot-air path 26 between the rotating container 3 and the water tub 2.

Under the water tub 2, a bedplate 31 is disposed on the bottom face of the outer casing 1 via a plurality of cushions 30. An airflow duct 32 is disposed on the bedplate 31. An airflow intake opening 33 is formed in the upper portion at the front end side of the airflow duct 32, and the airflow intake opening 33 is connected via a connecting hose 35 and an airflow returning duct 34 to the hot-air exit 10 of the water tub 2. The airflow returning duct 34 is piped so as to circumvent the left side of the bellows 7.

On the other hand, a casing 37 of an air circulation blower 36 is connected to the rear end side of the airflow duct 32. An exit portion 38 of the casing 37 is connected via a connecting hose 39 and an airflow supply duct 40 to the hot-air entrance 11 of the water tub 2. The airflow supply duct 40 is piped so as to circumvent the left side of the motor 21.

The hot-air exit 10 and the hot-air entrance 11 of the water tub 2 are, as described above, connected through the airflow returning duct 34, the connecting hose 35, the airflow duct 32, the casing 37, the connecting hose 39, and the airflow supply duct 40, whereby an airflow path 41 is formed.

The air circulation blower 36 is composed of a blower fan 42 provided inside the casing 37 and a motor 43 provided outside the casing 37, that rotates the blower fan 42.

Figure 3:
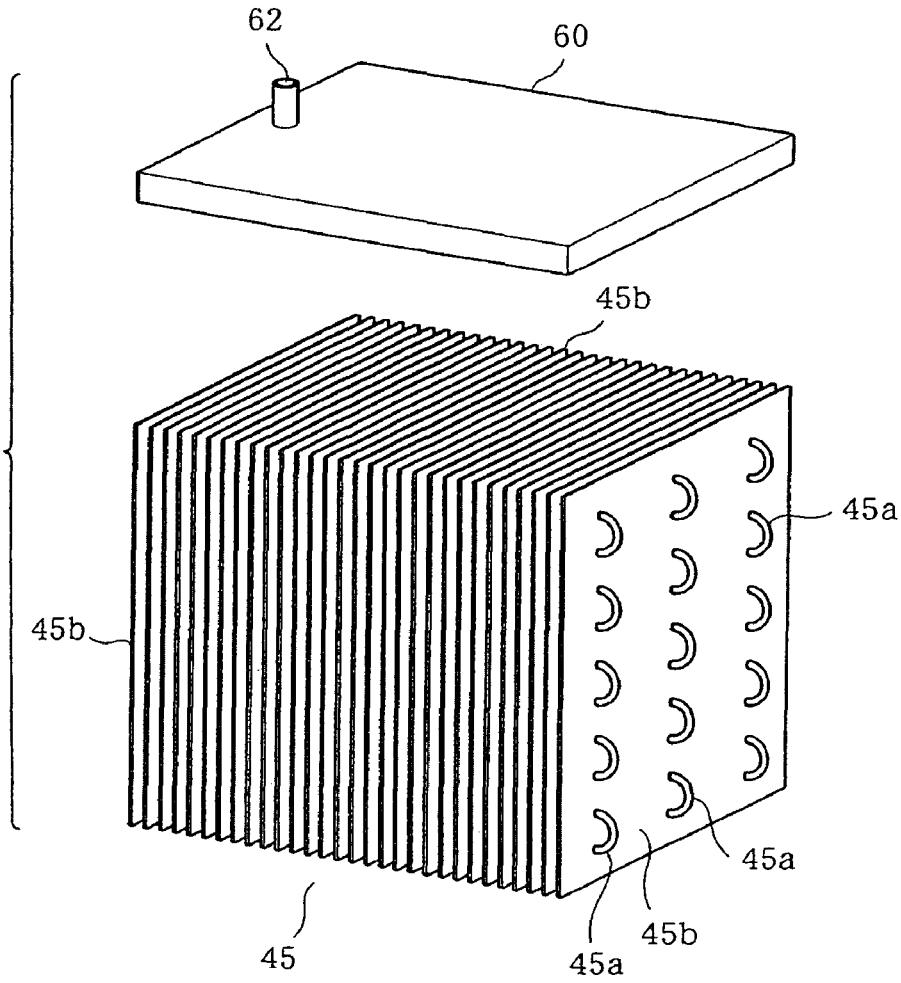
FIG. 3 is a perspective view showing a condenser and a cooling device.

An evaporator 44 is disposed at the front portion of the airflow duct 32 inside the airflow path 41. Accordingly, the evaporator 44 is disposed at the front face side of the washer-dryer, and a condenser 45 is disposed at the back face side of the washer-dryer. As shown in FIG. 3, the condenser 45 has a structure in which many heat transfer fins 45*b* are attached to refrigerant distribution pipes 45*a* curved so as to wind as such. In this case, the heat transfer fins are disposed in a direction parallel to a flow of air blow passing through the airflow duct 32 which will be described later, and the air blow passing through the airflow duct 32 passes through among the heat transfer fins.

Figure 2:
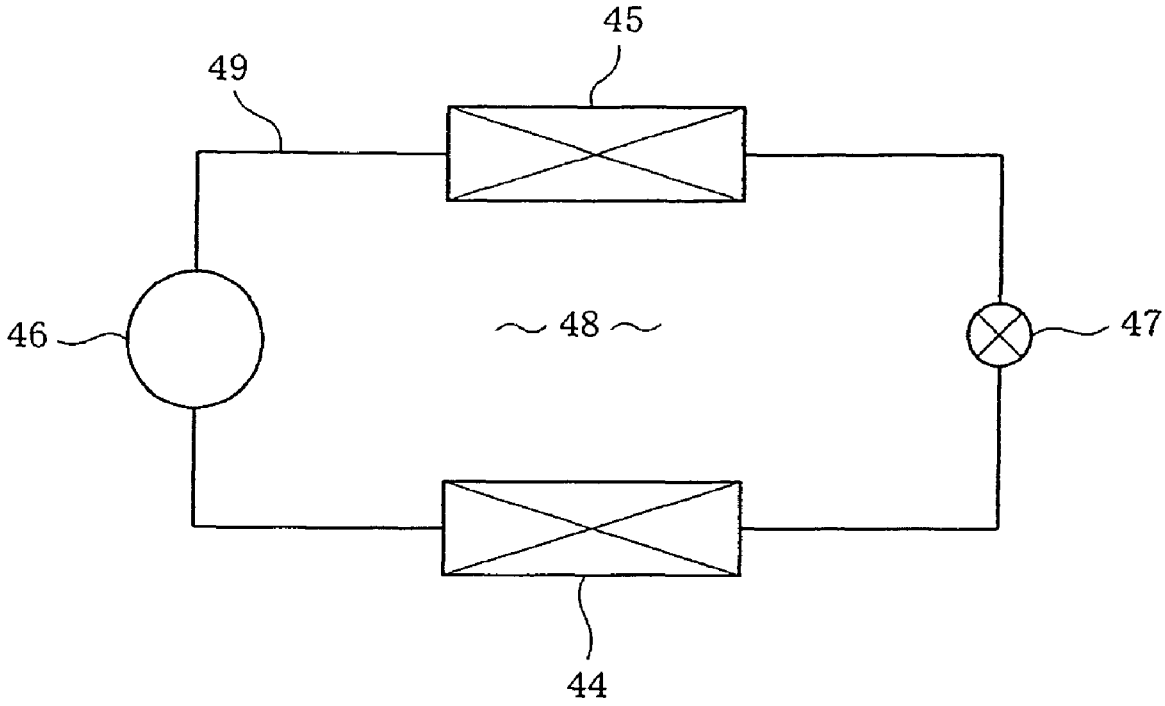
FIG. 2 is a schematic block diagram of a heat pump.

The evaporator 44 and the condenser 45 form a heat pump 48 along with a compressor 46 and an electronic throttling valve 47 as shown in FIG. 2. In this heat pump 48, the evaporator 44, the condenser 45, the compressor 46, and the throttling valve 47 are circularly connected through a refrigerant distribution pipe 49. Then, when the compressor 46 is operated, refrigerant circulates through the compressor 46, the condenser 45, the throttling valve 47, and the evaporator 44 in this order. The compressor 46 is installed outside the airflow duct 32 so as to be adjacent thereto.

A dehumidified water drain outlet 50 is formed in the side face of the airflow duct 32. The dehumidified water drain outlet 50 faces a lowermost portion 32*a* of the airflow duct 32 between the airflow intake opening 33 and the evaporator 44. The dehumidified water drain outlet 50 is connected through a connecting pipe 52 to the drain outlet 51 formed in the lower portion of the side face of the outer casing 1. The drain outlet 51 is connected through a connecting pipe 54 to a cooling water drain outlet 53 formed in a portion right in front of the condenser 45 at the bottom face of the airflow duct 32. An inclined surface 32*b* coming down toward the dehumidified water drain outlet 50 is provided to a portion immediately beneath the evaporator 44 at the bottom face of the airflow duct 32. Further, an inclined surface 32*c* coming down toward the cooling water drain outlet 53 is provided to a portion immediately posterior to the evaporator 44.

A discharge airflow path 55 leading to the outside from a portion between the rotating container 3 and the evaporator 44 in the airflow path 41 toward the front side of the washer-dryer is provided to the front end portion of the airflow duct 32 in the airflow path 41. The discharge airflow path 55 is communicated with the airflow duct 32, and a damper 56 is provided to the portion through which the discharge airflow path 55 and the airflow duct 32 are communicated with one another. The damper 56 pivots on (one end portion at the discharge airflow path 55 side in a state shown in FIG. 5) due to power of the drive unit (now shown) such as a motor or an electromagnet. By this structure, the damper 56 functions as an airflow path switching unit that switches a state in which the front end portion of the airflow duct 32 (the portion between the rotating container 3 and the evaporator 44 in the airflow path 41) is opened and the discharge airflow path 55 is blocked off (the state shown in FIG. 1), and a state in which the front end portion of the airflow duct 32 is blocked off and the discharge airflow path 55 is opened (the state shown in FIG. 5).

An air discharge blower 57 is provided inside the discharge airflow path 55, and the exit portion of the discharge airflow path 55 located in front of the air discharge blower 57 is opened obliquely upward. A louver 58 inclined obliquely upward is provided inside the exit portion of the discharge airflow path 55.

Figure 4:
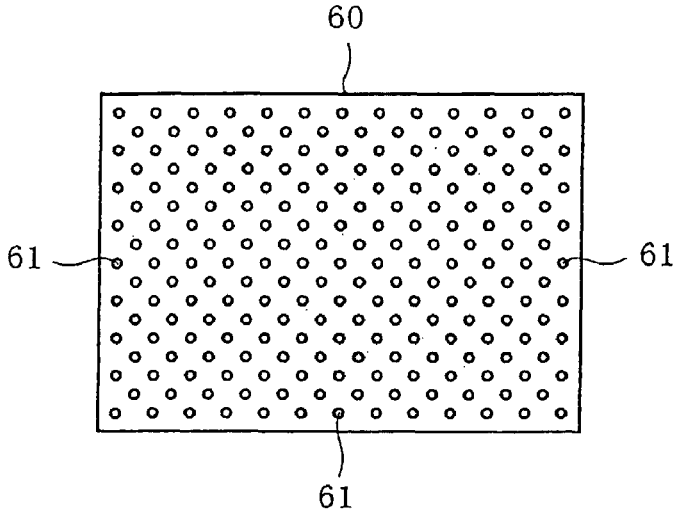
FIG. 4 is a bottom plan view of the cooling device.

An air inlet 59 is formed in a portion between the evaporator 44 and the condenser 45 in the airflow path 41 (an intermediate portion of the upper wall of the airflow duct 32). The condenser is provided with a cooling device 60. The cooling device 60 is composed of a quadrangular flat container placed on the condenser 45 as shown in FIG. 3, and many water spray holes 61 are provided in substantially the entire surface, as shown in FIG. 4, in the lower wall portion contacting the condenser 45. A water receiving opening 62 is provided to one end side of the upper wall portion of the cooling device 60, and an leading end portion of a water tube 63 shown in FIG. 1 is connected to the water filling receiving opening 62.

A base end portion of the water filling tube 63 is connected to an exit portion of a feed water valve 64 attached to the upper portion at the back face side in the outer casing 1. Not only the exit portion to which the base end portion of the water filling tube 63 is connected, but also a plurality of exit portions is provided in the feed water valve 64, and those exit portions are connected through a connecting pipe 66 to a feed water box 65 disposed at the upper portion at the front face side in the outer casing 1. Unillustrated detergent dropping portion and softener dropping portion are provided to the feed water box 65. Then, by selecting an exit portion to be opened, the feed water valve 64 feeds the inside of the water tub 2 with water through the detergent dropping portion of the feed water box 65 in the washing operation, and feeds the inside of the water tub 2 with water through the softener dropping portion of the feed water box 65 in the final rinsing operation, and feeds the cooling device 60 with water through the water filling tube 63 in cooling the space where the washer-dryer is placed.

An external air intake opening 67 is formed in the lower portion of the back face of the outer casing 1.

Next, the operations of the washer-dryer having the above-described structure will be described.

When a standard driving course is started, first, the washer-dryer executes a washing operation (a washing motion and a rinsing motion). In this washing operation, the washer-dryer feeds the inside of the water tub 2 with water through the feed water valve 64, and next, the washer-dryer operates the motor 21 to rotate the rotating container 3 in a positive direction and a negative direction alternately at low speed.

When the washing operation is completed, the washer-dryer executes a dehydrating operation. In the dehydrating operation, after the washer-dryer discharges the water in the water tub 2, the washer-dryer rotates the rotating container 3 in one direction at high speed. In accordance therewith, the laundry (clothes) in the rotating container 3 is centrifugally dehydrated.

When the dehydrating operation is completed, the washer-dryer executes a drying operation. In the drying operation, the washer-dryer switches the damper 56 such that the front end portion of the airflow duct 32 is opened, and the discharge airflow path 55 is blocked off. In this state, the washer-dryer rotates the rotating container 3 in a positive direction and a negative direction at low speed, and operates the motor 43 of the air circulation blower 36 to rotate the blower fan 42. When the blower fan 42 is rotated, the air in the water-tub 2 goes from the hot-air exit 10 through the airflow returning duct 34 and the connecting hose 35 to flow into the airflow duct 32.

At this time, the washer-dryer operates the compressor 46 of the heat pump 48. When the compressor 46 is operated, the refrigerant enclosed in the heat pump 48 is compressed to be a refrigerant of high-temperature and pressure so as to flow into the condenser 45. The high-temperature and pressure refrigerant flowing in the condenser 45 is condensed by the condenser 45, and at that time, heat exchange is carried out between the refrigerant and the air in the airflow duct 32. As a result, the air in the airflow duct 32 is heated, and in contrast thereto, the refrigerant is lowered in temperature to be liquefied. The liquefied refrigerant is depressurized at the time of passing through the throttling valve 47, and thereafter, the refrigerant flows into the evaporator 44. The refrigerant flowing in the evaporator 44 is evaporated by the evaporator 44, and at this time, heat exchange is carried, out between the refrigerant and the air in the airflow duct 32. As a result, the air in the airflow duct 32 is cooled down, and in contrast thereto, the refrigerant is returned to the compressor 46 in a state of drawing heat from the air in the airflow duct 32.

In accordance with this structure, the air flowing into the airflow duct 32 from the inside of the water tub 2 is cooled down to be dehumidified by the evaporator 44, and thereafter, the air is heated up to be hot air in the condenser 45. Then, the hot air passes through the connecting hose 39 and the airflow supply duct 40 to flow from the hot-air entrance 11 into the water tub 2. The hot air flowing in the water tub 2 passes through the hot air path 26 and the hot-air induction path 28 to be supplied from the hot air inlet 17 into the rotating container 3.

The hot air supplied into the rotating container 3 dehydrates the laundry, and thereafter, the hot air goes from the hot-air exit 10 through the airflow returning duct 34 and the connecting hose 35 to flow into the airflow duct 32.

In this way, due to the air circulating between the airflow duct 32 having the evaporator 44 and the condenser 45, and the rotating container 3, the laundry in the rotating container 3 is dried. In the drying operation, in the evaporator 44, the air passing through the inside of the airflow duct 32 is cooled down to be dehumidified. In accordance therewith, the moisture included in the air is condensed to be dew on the surface of the evaporator 44, and the dew condensation water falls in drops onto the inclined surface 32*b* of the airflow duct 32 located immediately beneath the evaporator 44. The dew condensation water falling in drops onto the inclined surface 32*b* of the airflow duct 32 flows downward on the inclined surface 32*b* of the airflow duct 32 to be discharged to the outside of the washer-dryer through the connecting pipe 52 and the drain outlet 51 from the dehumidified water drain outlet 50.

Figure 5:
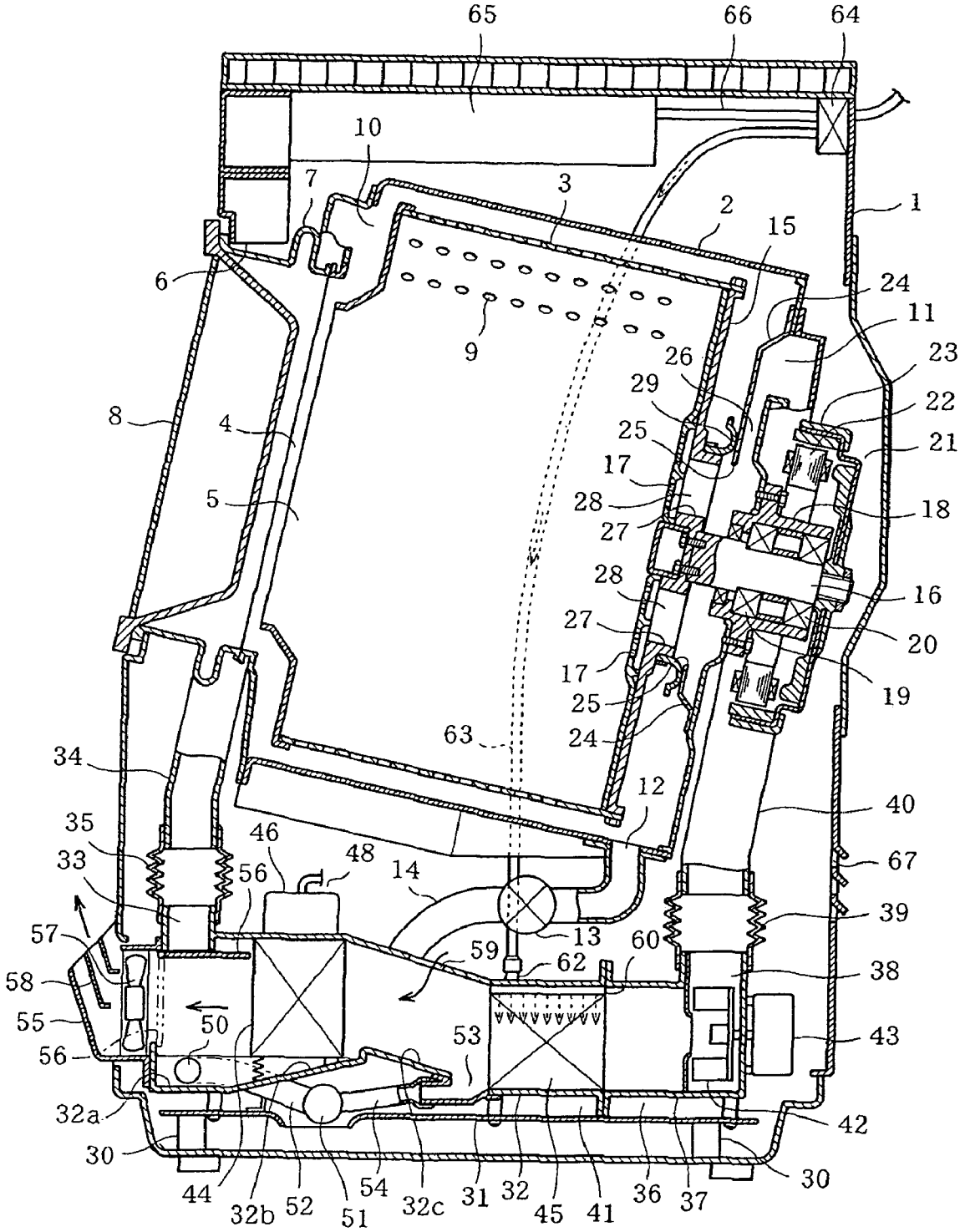
FIG. 5 is a longitudinal sectional side view showing a state in the cooling operation of the clothes dryer.

In contrast to the above-described drying operation, in the cooling operation to perform cooling of the space where the washer-dryer is placed, the washer-dryer switches the damper 56 such that the front end portion of the airflow duct 32 is blocked off and the discharge airflow path 55 is opened as shown in FIG. 5. In this state, the washer-dryer rotates the compressor 46 of the heat pump 48, and operates the air discharge blower 57.

In accordance therewith, the air in the airflow duct 32 is, as shown by the solid arrows in FIG. 5, sucked into the airflow duct 32 from the air inlet 59, and is cooled down at the time of passing through the evaporator 44. Then, the cooled air passes through the discharge airflow path 55 toward the front side of the washer-dryer to be discharged to the outside, which performs cooling of the space where the washer-dryer is placed. At that time, the air outside the washer-dryer is sucked from the external air intake opening 67 into the inside of the outer casing 1 to reach the external space of the airflow duct 32.

Further, in cooling the space where the washer-dryer is placed, as shown by the dashed arrows in FIG. 5, the washer-dryer feeds the cooling device 60 on the condenser 45 with water through the water filling tube 63 from the feed water valve 64. The cooling device 60 fed with water sprays water from the water spray holes 61 onto the condenser 45. In accordance therewith, the condenser 45 is cooled down by the water. In accordance with this structure, the condenser 45 radiates heat energy absorbed when the evaporator 44 cools down the air, and heat energy added due to the working of the compressor 46 to the water serving as a cooling medium. Accordingly, there are no cases in which the condenser 45 continues to exist in the calm airflow path 41 without radiating heat energy, and therefore, the condenser 45 can be activated as a cooling system for practical purposes, so that the space where the washer-dryer is placed can be cooled.

In accordance with experiments which have been carried out by the inventors, by using water of 1 liter to 1.5 liters per minute for cooling down the condenser 45, a space whose floor area is 4 $m^2$ (a space in size where it is possible for an individual to take off his/her clothes) has been able to be cooled down by approximately 10° C. for about one hour. Accordingly, it has been confirmed that the washer-dryer has functioned as a cooling device.

The water drawing heat energy from the condenser 45 goes from the cooling water drain outlet 53 through the connecting pipe 54 and the drain outlet 51 to be discharged to the outside of the washer-dryer.

The above-described washer-dryer is configured to cool down the condenser 45 in cooling the space where the washer-dryer is placed. However, the washer-dryer is not configured to block off a flow of the air going from the air inlet 59 toward the condenser 45 side. However, the airflow path 41 (the airflow path running through the condenser 45 in the drying operation) is formed so as to be connected to the rotating container 3 via the airflow supply duct 40 and the like, and is further connected to the airflow returning duct 34 from the rotating container 3, which makes the airflow path 41 to be substantially hermetically sealed. Accordingly, in the cooling operation, when the airflow returning duct 34 (the portion between the rotating container 3 and the evaporator 44 in the airflow path 41) is blocked off by the damper 56, the portion at which the condenser 45 is disposed in the airflow path 41 is made to be substantially blocked off. In accordance therewith, even if the air inlet 59 is provided between the evaporator 44 and the condenser 45, a flow of air from the air inlet 59 toward the condenser 45 side is not actually generated. Accordingly, provided that only the one damper 56 is provided, it is possible to perform cooling.

The portion at which the air inlet 59 is formed in the airflow duct 32 is located on the leeward of the circulating airflow generated by the air blower 36 for circulation in the drying operation, and is a place in negative pressure with respect to the windward side. Accordingly, there is a risk that the dew condensation water generated in the evaporator 44 will splatter on the condenser 45 side to damage the dehumidification function by the evaporator 44. However, in accordance with the washer-dryer, because a slight amount of air flows into the airflow duct 32 from the air inlet 59, the negative pressure is eased in the portion at which the air inlet 59 is formed in the airflow duct 32. In accordance therewith, the dehumidification function by the evaporator 44 is not damaged in the drying operation, and the drying performance is not deteriorated in any case.

As described above, in accordance with the present embodiment, the damper 56 is switched so as to open the discharge airflow path 55, and the heat pump 48, the air discharge blower 57, and the cooling device 60 are operated in this state, it is possible not only to cool down the condenser 45 by the cooling device 60, but also to cool down air outside the airflow path 41 introduced from the air inlet 59 by the evaporator 44 to be discharged from the discharge airflow path 55 to the outside of the washer-dryer. In accordance therewith, it is possible to perform cooling of the space where the washer-dryer is placed by utilizing the heat pump 48 for drying clothes.

The cooling device 60 is configured to cool down the condenser 45 with water. By employing a water cooling system excellent in cooling effect, it is possible to more effectively perform cooling of the space where the washer-dryer is placed. Further, the cooling device 60 sprays water like a shower from the many water spray holes 61 onto the condenser 45. In accordance therewith, it is possible to pour water onto the condenser 45 widely to effectively cool down the condenser 45, and the space where the washer-dryer is placed can be cooled even more effectively.

In the washer-dryer disclosed in the prior art document 1, the evaporator is disposed at the back face side of the washer-dryer so as to be located behind the condenser. Therefore, it is necessary to provide an airflow path for cooling to perform cooling of the space where the washer-dryer is placed separately from the airflow path for drying. Further, it is necessary to provide an airflow path for cooling so as to circumvent the condenser to lead to the outside of the washer-dryer. However, considering the volume and the like of the entire washer-dryer, it is difficult to secure a space where an airflow path for cooling is provided. Further, in order to provide an airflow path for cooling, it is necessary to complicate the airflow path so as to circumvent the condenser or the like. In particular, in the washer-dryer that carries out drying and cooling by using the heat pump 48, the evaporator 44 and the condenser 45 each have a high resistance against the flow of air because of the washer-dryer structure. Therefore, if the airflow path is complicated, it is impossible to secure an air volume sufficiently.

In contrast thereto, in the structure of the present embodiment, as described above, the evaporator 44 is disposed at the front face side of the washer-dryer, and is located in front of the condenser 45. Therefore, there is no need to provide an airflow path for cooling which circumvents the condenser 45 to lead to the outside of the washer-dryer. Accordingly, there is no need to enlarge the volume of the entire washer-dryer in order to provide an airflow path for cooling. Further, in the cooling operation, the air outside the airflow duct 32 flows in from the air inlet 59 to pass through the evaporator 44 to be discharged from the front side discharge airflow path 55 to the outside of the washer-dryer. Therefore, the resistance in the airflow path in the cooling operation is reduced, and it is possible to secure a sufficient airflow volume and to provide a sufficient cooling performance.

In the washer-dryer disclosed in the prior art document 1, the air blower for discharge is disposed posterior to the evaporator, and is configured to feed air outside the air circulating path to the airflow path for cooling. In this structure, it is necessary to switch the airflow path by disposing many dampers. Further, the evaporator composed of many heat transfer fins generally used for a heat pump has high air resistance. Therefore, unless the sealing performance in the airflow path is improved by the dampers, it is difficult to make an airflow required for cooling. In contrast thereto, in the structure of the present embodiment, as described above, the air blower for discharge 57 is disposed anterior to the evaporator 44, and it is possible to efficiently suck air through the evaporator 44. Further, as described above, by providing the only one damper 56, it is possible to switch from a state in the drying operation to a state in the cooling operation. Accordingly, it is possible to perform cooling of the space where the washer-dryer is placed with an extremely simple structure.

Because the inclined surface 32*c* coming down toward the cooling water drain outlet 53 is provided, it is possible to render water flowing into the condenser 45 difficult to overflow to the evaporator 44 side.

Second Embodiment

Figure 6:
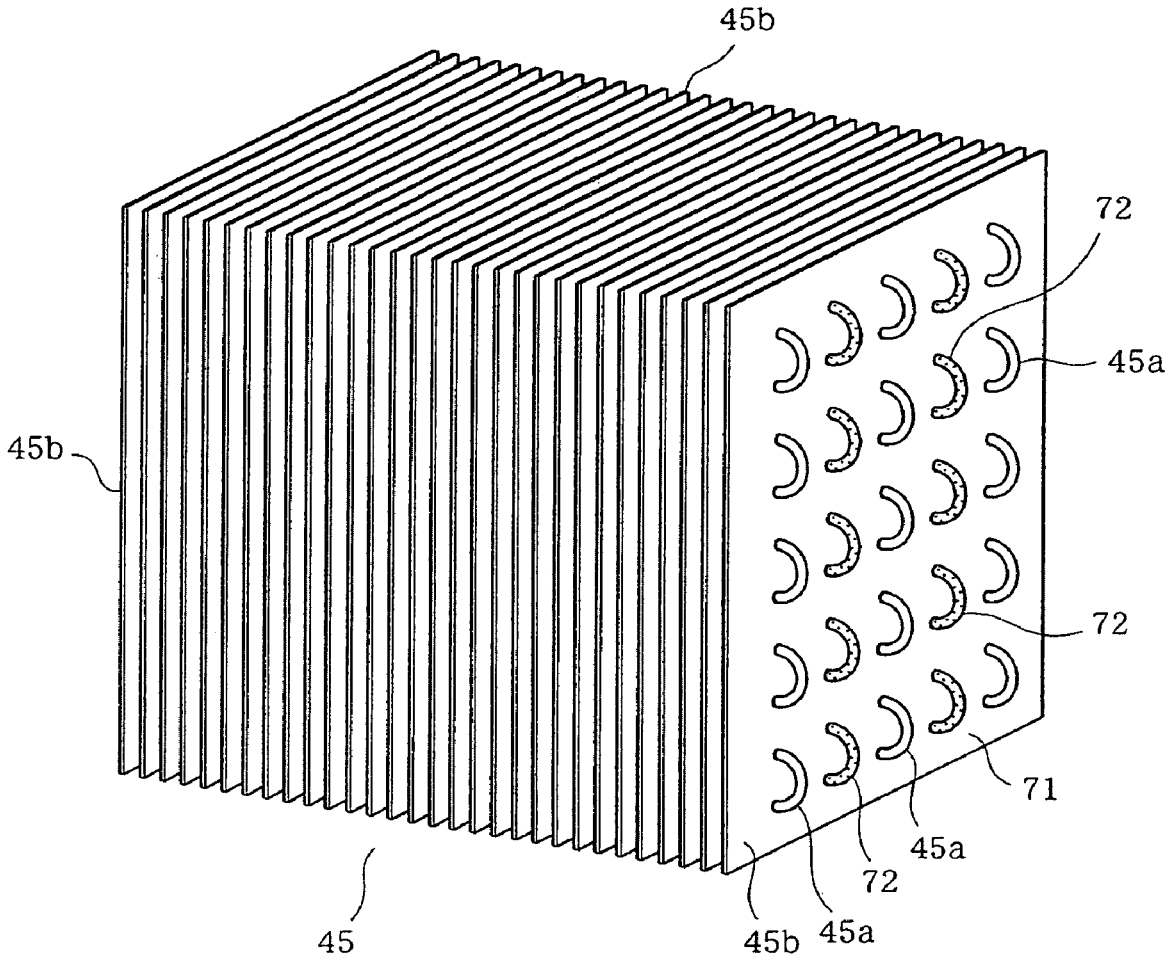
FIG. 6 is a perspective view showing the condenser including the cooling device in a second embodiment of the present invention.

Next, a second embodiment of the present invention will be described with reference to FIG. 6. In addition, portions which are the same as those of the first embodiment described above are denoted by the same reference numerals, and descriptions thereof will be omitted, and only different portions will be described.

In the present embodiment, in place of the cooling device 60, a cooling device 71 that cools down the condenser 45 is provided. The cooling device 71 is composed of water flow pipes 72 made to pass through the condenser 45. The above-described refrigerant distribution pipes 45*a* are arrayed in rows vertically with predetermined intervals horizontally. The water flow pipes 72 are arrayed so as to be adjacent to the refrigerant distribution pipes 45*a* among the respective rows of the refrigerant distribution pipes 45*a*. That is, the water flow pipes 72 and the refrigerant distribution pipes 45*a* are disposed so as to be horizontally aligned along one another. The leading end portion of the water filling tube 63 is connected to the base end portions of the water flow pipes 72 (the entrance portion to the condenser 45), and the water flowing into the base end portions of the water flow pipes 72 are to be discharged from the leading end portions of the water flow pipes 72 (the exit portion from the condenser 45). The heat transfer fins 45*b* are cooled down by the water flowing in the water flow pipes 72, and thereby cooling down the entire condenser 45.

In accordance with the present embodiment, it is possible to more efficiently cool down the condenser 45, and it is possible to more effectively perform cooling of the space where the washer-dryer is placed.

In this case, the leading end portions of the water flow pipes 72 may be directly connected to the drain outlet 51 to discharge the water made to flow into the water flow pipes 72.

Further, the water flow pipes 72 may be disposed so as to be shifted by half a pitch vertically with respect to the refrigerant distribution pipes 45*a*. In accordance with the structure, it is possible to change an airflow passing through the condenser 45 (among the heat transfer fins 45*b*), and it is possible to improve the efficiency of heat exchange at the time of generating hot air in the condenser 45.

Further, the leading end portions of the water flow pipes 72 may be provided at the side of the leading end portions of the refrigerant distribution pipes 45*a* (the exit portion from the condenser 45), and the leading end portions of the water flow pipes 72 may be provided at the side of the base end portions of the refrigerant distribution pipes 45*a* (the entrance portion from the condenser 45). In accordance with the structure, a direction of the water flowing in the water flow pipes 72 and a direction of the refrigerant flowing in the refrigerant distribution pipes 45*a* are opposed to one another, and it is possible to keep a difference in temperature between the water flowing in the water flow pipes 72 and the refrigerant flowing in the refrigerant distribution pipes 45*a* high in any portion of the condenser 45 and accordingly, the condenser 45 can effectively be cooled.

Third Embodiment

Next, a third embodiment of the present invention will be described with reference to FIG. 7. The present embodiment has a structure in which the condenser 45 is cooled down with air by utilizing the above-described air blower 36 for circulation.

At the back face side of the washer-dryer, an air-cooling exhaust opening 81 leading to the outside of the washer-dryer from the portion between the condenser 45 and the rotating container 3 in the airflow path 41 is provided. The air-cooling exhaust opening 81 diverges from the exit portion 38 of the airflow duct 32, and the leading end portion thereof is directed externally from the washer-dryer backward from the back face of the outer casing 1. A damper 82 is provided to the portion through which the air-cooling exhaust opening 81 and the exit portion 38 of the airflow duct 32 are communicated with one another. The damper 82 rotates centering on one end portion at the air-cooling exhaust opening 81 side due to power of a drive unit (now shown) such as a motor or an electromagnet. In accordance with this structure, the damper 82 switches a state in which the leading end portion of the exit portion 38 of the airflow duct 32 (the portion between the condenser 45 and the rotating container 3 in the airflow path 41) is blocked off and the air-cooling exhaust opening 81 is opened (the state shown by the solid line in FIG. 7), and a state in which the leading end portion of the exit portion 38 of the airflow duct 32 is opened and the air-cooling exhaust opening 81 is blocked off (the state shown by the chain double-dashed line in FIG. 7). In this case, the above-described damper 56 functions as a first airflow path switching unit, and the damper 82 functions as a second airflow path switching unit.

Next, the operations of the washer-dryer having the above-described structure will be described.

Figure 7:
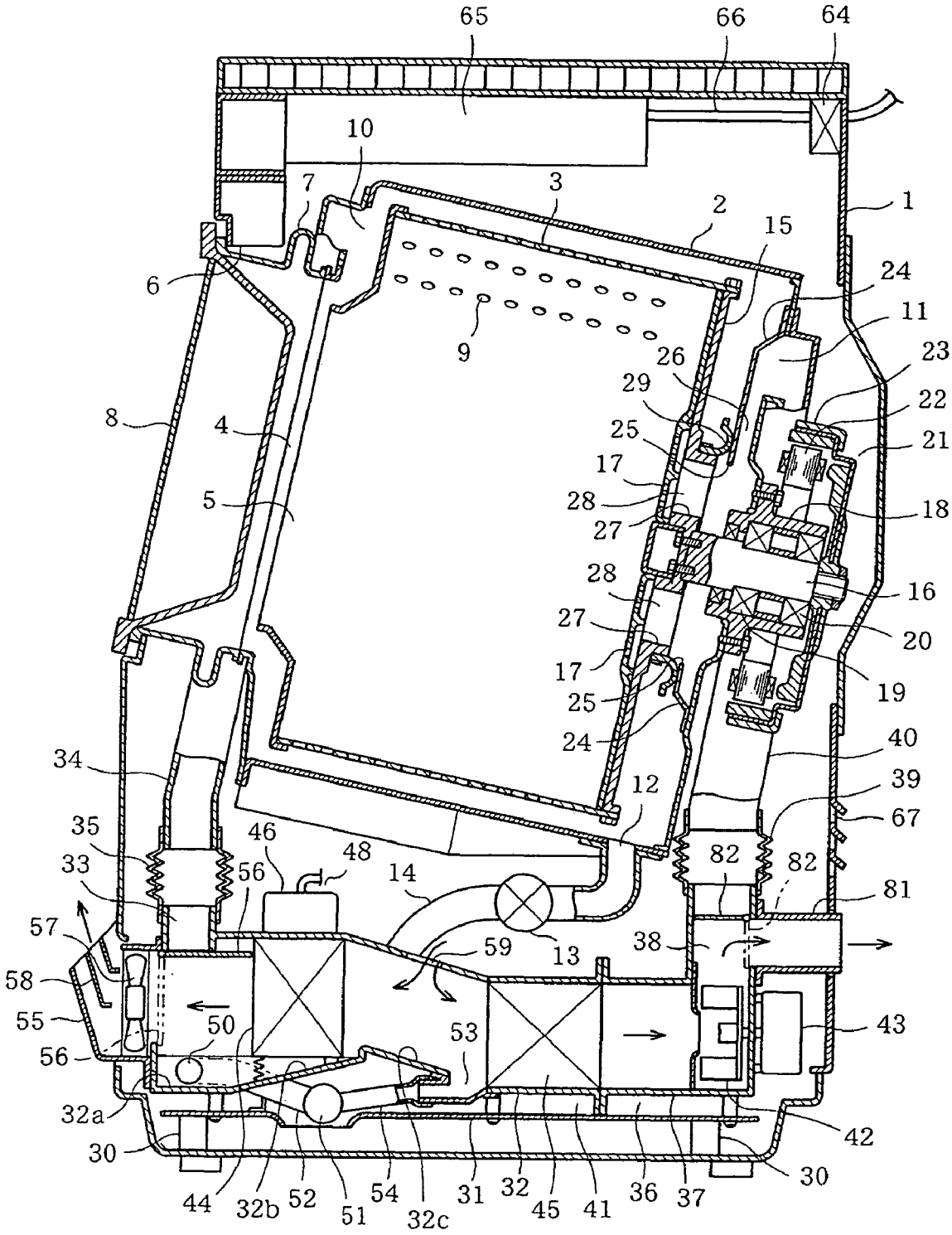
FIG. 7 is a diagram corresponding to FIG. 5, which shows a third embodiment of the present invention.

In cooling the space where the washer-dryer is placed, as shown in FIG. 7, the washer-dryer switches the damper 56 such that the front end portion of the airflow duct 32 is blocked off and the discharge airflow path 55 is opened. Then the washer-dryer operates the compressor 46 of the heat pump 48 and the air discharge blower 57. Further, the washer-dryer switches the damper 82 such that the leading end portion of the exit portion 38 of the airflow duct 32 is blocked off and the air-cooling exhaust opening 81 is opened. Then, the washer-dryer operates the air circulation blower 36.

Consequently, the air outside the airflow duct 32 is sucked from the air inlet 59 into the airflow duct 32, and is cooled down at the time of passing through the evaporator 44. Then, the cooled air goes from the discharge airflow path 55 toward the front side of the washer-dryer to be discharged to the outside. Further, the air outside the airflow duct 32 sucked from the air inlet 59 draws heat from the condenser 45 at the time of passing through the condenser 45. That is, the air outside the airflow duct 32 sucked from the air inlet 59 cools down the condenser 45, and the air is discharged to the outside of the washer-dryer from the air-cooling exhaust opening 81. Accordingly, in the present embodiment, the air blower 36 functions as a cooling device that cools down the condenser 45 with air (carries out air-cooling).

Further, an electronic control motor is adopted as the motor 43 that drives the air blower 36, and it is possible to change the volume of airflow generated by the air blower 36 by controlling a rotational speed of the motor 43. In cooling the space where the washer-dryer is placed, it is possible to cool down the condenser 45 by generating a volume of airflow of approximately half the volume of airflow in the drying operation.

In cooling the space where the washer-dryer is placed, the air discharged from the air-cooling exhaust opening 81 to the outside of the washer-dryer is hot. In this hot air, not only the heat energy absorbed when the evaporator 44 cools down the air, but also the heat energy added due to the working of the compressor 46 is included. That is, because the hot air discharged from the air-cooling exhaust opening 81 has energy greater than the heat energy absorbed when the evaporator 44 cools down air, the space where the washer-dryer is placed is gradually heated up overall. However, because a cold airflow at a temperature lower by approximately 10° C. than the room temperature of the space where the washer-dryer is placed is discharged from the discharge airflow path 55 of the front face side of the washer-dryer, it is possible for a user to be able to be directly subjected to the cold airflow.

As described above, in accordance with the present embodiment, it is possible to perform cooling of the space where the washer-dryer is placed by utilizing the heat pump 48 for drying clothes.

In this case, the air blower 36 is not used, but a dedicated air blower may be separately provided, which cools down the condenser 45 with air.

Fourth Embodiment

Next, a fourth embodiment of the present invention will be described with reference to FIG. 8. The present embodiment has a structure in which a partition damper 91 is further provided to the washer-dryer shown in the third embodiment.

Figure 8:
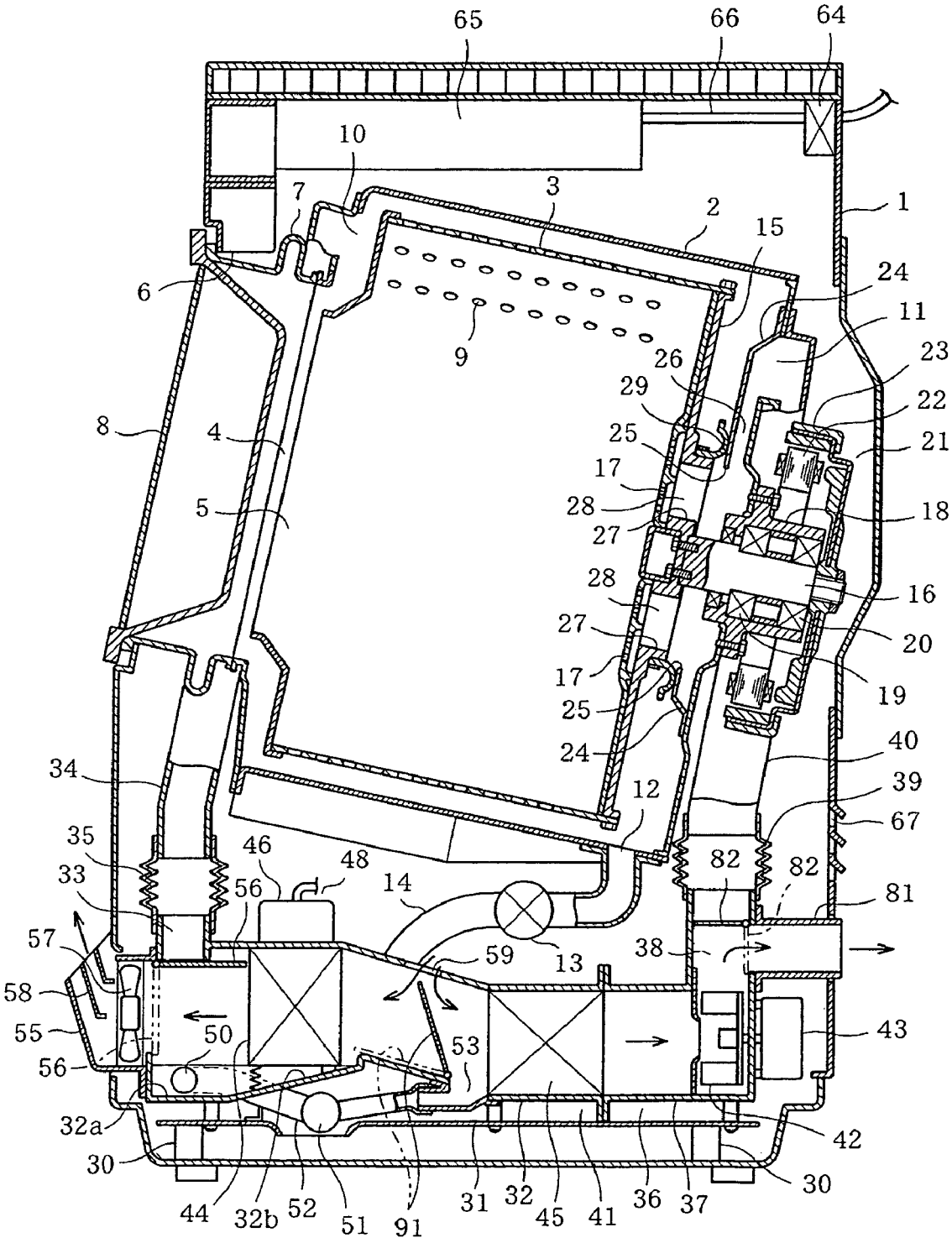
FIG. 8 is diagram corresponding to FIG. 5, which shows a fourth embodiment of the present invention.

The partition damper 91 is provided at a position under the air inlet 59 in the airflow duct 32, and is switched between a standing state (the state shown by the solid line in FIG. 8) and a laid state (the state shown by the chain double-dashed line in FIG. 8). In cooling the space where the washer-dryer is placed, the washer-dryer is controlled so that the partition damper 91 stands up to divide the air outside the airflow duct 32 introduced from the air inlet 59 into the evaporator 44 side and the condenser 45 side.

In accordance with the present embodiment, it is possible to stably introduce the air outside the airflow duct 32 introduced from the air inlet 59 to the evaporator 44 side and the condenser 45 side. In accordance therewith, it is possible to respectively efficiently perform cooling of the air introduced to the evaporator 44 side by the evaporator 44, and cooling of the condenser 45 by the air introduced to the condenser 45 side.

Fifth Embodiment

Figure 9:
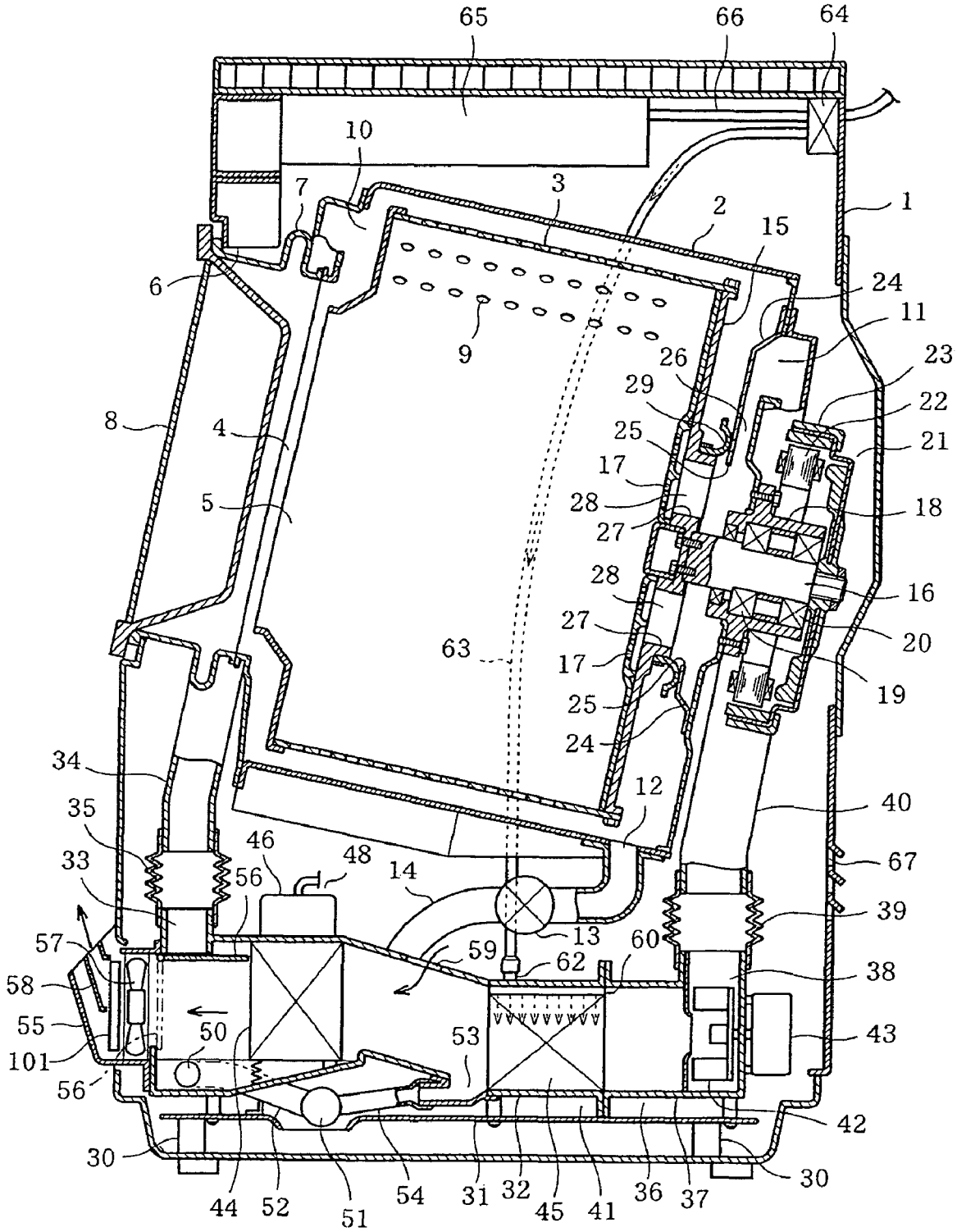
FIG. 9 is diagram corresponding to FIG. 5, which shows a fifth embodiment of the present invention.

Next, a fifth embodiment of the present invention will be described with reference to FIG. 9. The present embodiment has a structure in which a heater 101 to heat up air is provided at a position out of the airflow path 41. The heater 101 is particularly composed of an electric heater, and is provided inside the discharge airflow path 55 through which the air outside the airflow duct 32 introduced from the air inlet 59 to pass through the evaporator 44 is discharged to the outside of the washer-dryer.

In the heat pump 48, it is possible to use the evaporator 44 as a condenser, and to use the condenser 45 as an evaporator by switching the refrigerant flow path so as to pass from the evaporator 44 through the throttling valve 47 to flow into the condenser 45. Accordingly, it is considered possible to discharge hot air from the discharge airflow path 55 to perform heating of the space where the washer-dryer is placed because of its structure. However, in such a case, energy needs to be supplied to the condenser 45 functioning as the evaporator 44, from outside, so that the evaporator 45 functioning as the condenser generates heat. In the structure of the present embodiment, the condenser 45 is capable of absorbing energy from water provided to the condenser 45. However, as will be described in detail hereinafter, it is difficult to absorb energy at a level to perform heating of the space where the washer-dryer is placed.

In the cooling operation for performing cooling of the space where the washer-dryer is placed, for example, in order to cool down a space whose floor area is approximately 4 $m^2$ by approximately 10° C., the energy used for driving the compressor 46 is approximately 1.2 kWh in total. That is, assuming that energy of approximately 200 Wh is required for cooling down a space whose floor area is 1 $m^2$ by approximately 10° C., energy of approximately 800 Wh is required for cooling down a space whose floor area is approximately 4 $m^2$ by approximately 10° C. However, different from an air conditioner in which a compressor is installed outside a space to be cooled down, the compressor 46 of the present embodiment is installed inside the space to be cooled down. Therefore, it is necessary to cool down extra heat generated by driving the compressor 46 as well. Accordingly, assuming that the heat energy generated by driving the compressor 46 is 400 Wh, energy of approximately 1.2 kWh in total is required. When the energy of approximately 1.2 kWh is discharged by water of approximately 1.0 liter per minute to be supplied to the condenser 45, a temperature of the water supplied to the condenser 45 is logically increased by approximately 17° C. Assuming that a water temperature in summer of the water supplied to the condenser 45 is approximately 20° C., the water supplied to the condenser 45 is discharged as hot water whose temperature is slightly less than about 40° C., whereupon the space where the washer-dryer is placed can be cooled down.

On the other hand, in the heating operation for performing heating of the space where the washer-dryer is placed, for example, in order to increase a temperature of a space at a room temperature of approximately 5° C. by 15° C. to be approximately 20° C., energy of approximately 1.2 kWh which is 1.5 times as large as 800 Wh is required. However, the compressor 46 of the present embodiment is installed inside the space to be heated. Therefore, as energy used for driving the compressor 46, in contrast to the case where the above-described cooling is operated, energy of approximately 800 Wh in which energy of 400 Wh generated by driving the compressor 46 is subtracted from the energy of 1.2 kWh is sufficient. When the energy of approximately 800 Wh is absorbed from water of approximately 1.0 liter per minute to be supplied to the condenser 45, a temperature of the water supplied to the condenser 45 is logically decreased by approximately 14.5° C. Assuming that a temperature of the water supplied to the condenser 45 in winter is approximately 5° C., it is necessary to decrease the temperature of the water supplied to the condenser 45 to approximately −10° C. However, because water is frozen at 0° C., it is impossible to absorb more energy. Accordingly, in washer-dryers having the structures of the above-described respective embodiments, it is impossible to perform heating of the space where the washer-dryer is placed by utilizing the heat pump 48 practically.

In contrast thereto, in the washer-dryer of the present embodiment, the heater 101 is provided in the discharge airflow path 55 through which the air outside the airflow duct 32 introduced from the air inlet 59 to pass through the evaporator 44 is discharged to the outside of the washer-dryer. The heater 101 is preferably provided externally from the air discharge blower 57 in consideration of the effect of heat transferred to the air discharge blower 57.

According to the above-described embodiment, when the space where the washer-dryer is placed is to be heated, the discharge air blower 57 and the heater 101 are operated so that air that is present outside the airflow duct 32 and is introduced through the air inlet 59 may be heated by the heater 101 to be discharged out of the washer-dryer. As a result, the space where the washer-dryer is placed can be heated without operation of the heat pump 48.

In addition, in the present embodiment, the condenser 45 is to be cooled down by the cooling device 60 shown in the first embodiment. The condenser 45 may be cooled down by the cooling device 71 shown in the second embodiment in place of the cooling device 60. Moreover, the condenser 45 may be cooled down by the air blower for circulation 36 shown in the third and fourth embodiments.

Sixth Embodiment

Figure 10:
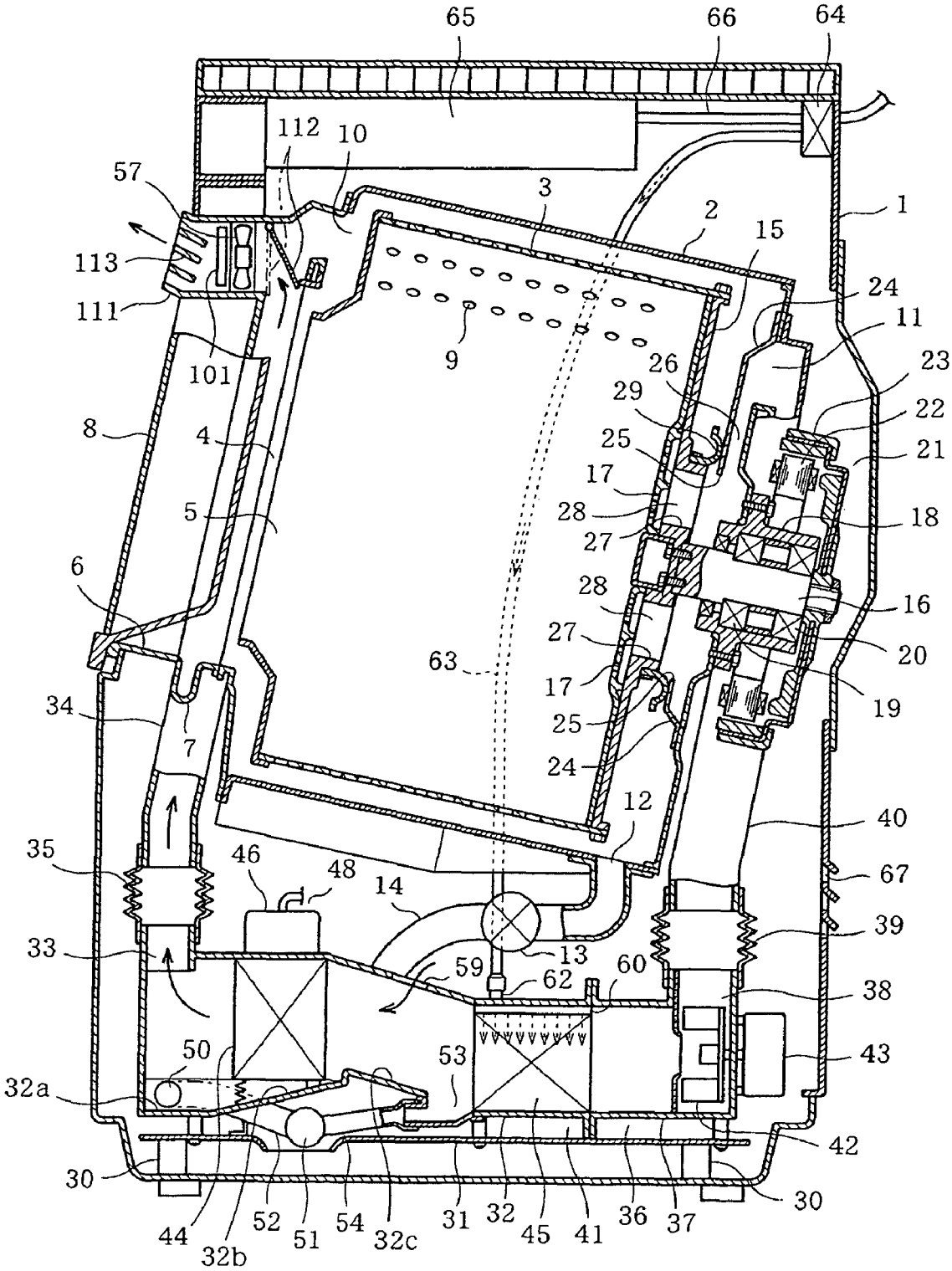
FIG. 10 is diagram corresponding to FIG. 5, which shows a sixth embodiment of the present invention.

Next, a sixth embodiment of the present invention will be described with reference to FIG. 10. In the present embodiment, a discharge airflow path 111 in place of the above-described discharge airflow path 55 is provided at the upper portion side of the washer-dryer. The discharge airflow path 111 is provided so as to go from the upper portion of the airflow returning duct 34 facing the hot-air exit 10 of the water tub 2 toward the front side of the washer-dryer to lead to the outside. The discharge airflow path 111 is communicated with the airflow returning duct 34, and a damper 112 is provided in a portion through which the discharge airflow path 111 and the airflow returning duct 34 are communicated with one another. The damper 112 pivots on the upper end portion (one end portion at the discharge airflow path 111 side) due to power of a drive unit (not illustrated) such as, a motor or an electromagnet. In accordance with this structure, the damper 112 switches a state in which the upper portion of the airflow returning duct 34 (the portion between the rotating container 3 and the evaporator 44 in the airflow path 41) is blocked off and the discharge airflow path 111 is opened (the state shown by the solid line in FIG. 10), and a state in which the upper portion of the airflow returning duct 34 is opened and the discharge airflow path 111 is blocked off (the state shown by the chain double-dashed line in FIG. 10). That is, the damper 112 functions as an airflow path switching unit in the same way as the damper 56.

The air discharge blower 57 is provided inside the discharge airflow path 111 along with the heater 101. A louver 113 inclined obliquely upward is provided to the exit portion of the discharge airflow path 111 located anterior to the air blower for discharge 57 and the heater 101.

In accordance with the present embodiment, because cold air in the cooling operation and hot air in the heating operation are discharged from the upper portion side of the washer-dryer, the user is easily subjected to the cold air in the cooling operation and the hot air in the heating operation. Accordingly, in cooling and heating the space where the washer-dryer is placed, it is possible for the user to directly feel coldness of cold air (refreshing feeling) and warmth of hot air more than a change in temperature of the space where the washer-dryer is placed. Further, it is possible to greatly shorten the time until the user is able to feel coldness of cold air and warmth of hot air.

In addition, in the present embodiment as well, the condenser 45 is to be cooled down by the cooling device 60 shown in the first embodiment. The condenser 45 may be cooled down by the cooling device 71 shown in the second embodiment in place of the cooling device 60. Moreover, the condenser 45 may be cooled down by the air blower 36 shown in the third and fourth embodiments.

Other Embodiments

In addition, the present invention is not limited to the above-described respective embodiments. The present invention may be modified or extended as follows for example.

The present invention is not limited to the washer-dryer in which the water tub and the rotating container are transversely disposed, and may be applied to a washer-dryer in which the water tub and the rotating container are longitudinally disposed. Further, the present invention is not limited to a washer-dryer having a washing function and a drying function, and may be applied to a clothes dryer having only a drying function.

The heater 101 is not limited to an electric heater, and may be composed of a sheathed heater for example.

Further, the present invention may be appropriately modified to be implemented within a range which does not deviate from the scope of the invention.

INDUSTRIAL APPLICABILITY

As described above, the clothes dryer according to the present invention is useful as a clothes dryer capable of performing cooling of the space where the clothes dryer is placed by utilizing the heat pump for drying clothes.

The invention claimed is:

1. A clothes dryer to perform a drying operation for drying clothes, comprising:

a water tub having a hot-air exit formed in a front thereof and a hot-air entrance formed in a rear thereof;

a rotating container provided in the water tub;

an airflow path connecting the hot-air exit and the hot-air entrance to each other;

a drive unit that rotates the rotating container;

an air circulation blower that circulates air in the water tub from the hot-air exit through the airflow path and the hot-air entrance into the water tub; and a heat pump formed by circularly connecting an evaporator and a condenser both of which are disposed in the airflow path, and a compressor;

a discharge airflow path leading to the outside of the clothes dryer from a portion between the rotating container and the evaporator in the airflow path, where the portion between the rotating container and the evaporator in the airflow path is toward a front of the clothes dryer;

an airflow path switching unit which is switched so as to open the portion between the rotating container and the evaporator in the airflow path in the drying operation, and to open the discharge airflow path in cooling an atmosphere in a place where the clothes dryer is placed;

an air inlet provided in a portion of an upper wall between the evaporator and the condenser in the airflow path, said upper wall defining the airflow path;

an air discharge blower that introduces air outside the airflow path from the air inlet to be passed through the evaporator, and discharges the air from the discharge airflow path to the outside of the clothes dryer; and a cooling device that cools down the condenser.

2. The clothes dryer according to claim 1, wherein the cooling device cools down the condenser with water.

3. The clothes dryer according to claim 2, further comprising water flow pipes made to pass through the condenser, wherein the cooling device cools down the condenser with water flowing in the water flow pipes.

4. The clothes dryer according to claim 3, wherein the water flow pipes are arrayed so as to be aligned along with refrigerant distribution pipes that circularly connect the evaporator, the condenser, and the compressor.

5. The clothes dryer according to claim 1, wherein the cooling device cools down the condenser with air.

6. The clothes dryer according to claim 5, wherein the evaporator is disposed at a front face side of the clothes dryer, the condenser is disposed at a back face side of the clothes dryer, the discharge airflow path is disposed at the front face side of the clothes dryer, and an air-cooling outlet leading to the outside of the clothes dryer from the portion between the condenser and the rotating container in the airflow path is provided to the back face side of the clothes dryer.

7. The clothes dryer according to claim 1, further comprising a heater that heats up air, wherein the discharge airflow path is configured to be able to discharge the air heated by the heater.

8. The clothes dryer according to claim 7, wherein the heater is provided at a position out of the airflow path.

9. The clothes dryer according to claim 1, wherein the evaporator is disposed at the front face side of the clothes dryer, and the discharge airflow path is disposed at the front face side of the clothes dryer.

10. The clothes dryer according to claim 1, wherein the discharge airflow path is disposed at an upper portion side of the clothes dryer.

* * * * *